US007341333B2

(12) United States Patent
Sugahara

(10) Patent No.: US 7,341,333 B2
(45) Date of Patent: Mar. 11, 2008

(54) APPARATUS FOR EJECTING DROPLETS

(75) Inventor: Hiroto Sugahara, Ama-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 131 days.

(21) Appl. No.: 11/187,905

(22) Filed: Jul. 25, 2005

(65) Prior Publication Data

US 2006/0023035 A1 Feb. 2, 2006

(30) Foreign Application Priority Data

Jul. 28, 2004 (JP) ..... 2004-219900

(51) Int. Cl.
*B41J 2/07* (2006.01)

(52) U.S. Cl. ..... 347/74

(58) Field of Classification Search ..... 347/73, 347/74, 75, 76, 77, 90
See application file for complete search history.

(56) References Cited

U.S. PATENT DOCUMENTS 6,682,182 B2 * 1/2004 Jeanmaire et al. ..... 347/74
2004/0046825 A1 3/2004 Sugahara
2004/0095441 A1 5/2004 Jeanmaire

FOREIGN PATENT DOCUMENTS

| | | |
|---|---|---|
| EP | 1 398 155 | 3/2004 |
| JP | 7285222 | 10/1995 |
| JP | 2004122775 | 4/2004 |

OTHER PUBLICATIONS

ANONYMOUS: "Deposition of Small Paticles on Surfaces Using Magnetic Ink Jet Satellites. Oct. 1974." IBM Technical Disclosure Bulletin, vol. 17, No. 5, Oct. 1, 1974, pp. 1527-1528, New York, US.

* cited by examiner

*Primary Examiner*—K. Feggins
(74) *Attorney, Agent, or Firm*—Banner & Witcoff, LTD

(57) ABSTRACT

An apparatus for ejecting droplets comprises a reservoir, a pressure applicator, a nozzle hole, and a main droplet catcher. In the reservoir, liquid is reserved. The pressure applicator applies pressure to the liquid reserved in the reservoir. The nozzle hole communicates with the reservoir and has an ejection opening that can sequentially eject a main droplet and a satellite droplet having a volume smaller than that of the main droplet. The main droplet catcher is positioned between the nozzle hole and an ejection object so as to come into contact with the main droplet but not with the satellite droplet, to thereby catch the main droplet alone.

7 Claims, 13 Drawing Sheets

APPARATUS FOR EJECTING DROPLETS

BACKGROUND OF THE INVENTION

1. Field of the Invention

The present invention relates to an apparatus for ejecting droplets.

2. Description of Related Art

It is required that an ink-jet head for ejecting ink to a recording sheet should be able to eject fine ink droplets in order to realize a high-quality printing. Also required is a technique for ejecting fine droplets to an ejection object in order to form a fine wiring pattern on a substrate by ejecting a conductive paste, to form a high-resolution display by ejecting an organic luminescent material onto a substrate, to form a micro-optical device such as an optical waveguide by ejecting optical plastics onto a substrate, and the like.

In an ink-jet head, for example, when a diameter of a nozzle hole for ejecting ink is reduced, an ink droplet ejected therefrom becomes smaller to a certain extent. Also proposed is to control an ejection pulse signal which will be supplied to an actuator that causes an ink droplet to be ejected from a nozzle hole. Thereby, an ink droplet having an arbitrary size may be ejected from a nozzle hole. For example, Japanese Patent Unexamined Publication No. 7-285222 discloses an ink-jet recording apparatus which controls an ejection pulse signal so that a main droplet firstly ejected from a nozzle hole and a satellite droplet subsequently ejected may have the same weight. This ink-jet recording apparatus allows a resolution along a main scanning direction to be substantially doubled.

SUMMARY OF THE INVENTION

However, considering a manufacturing technique and a manufacturing cost, reduction in diameter has its limit. Moreover, although in the above-mentioned reference the main droplet and the satellite droplet have substantially the same size, in fact it is almost impossible that both the main and satellite droplets ejected from the nozzle hole are made into fine droplets because the nozzle hole has a certain extent of diameter. Therefore, this technique for ejecting droplets sees difficulty in forming fine dots onto an ejection object in order to achieve a high-quality printing or a very fine wiring pattern.

An object of the present invention is to provide an apparatus for ejecting droplets which can form a fine dot onto an ejection object.

According to a first aspect of the present invention, there is provided an apparatus for ejecting droplets comprising a reservoir, a pressure applicator, a nozzle hole, and a main droplet catcher. In the reservoir, liquid is reserved. The pressure applicator applies pressure to the liquid reserved in the reservoir. The nozzle hole communicates with the reservoir and has an ejection opening that can sequentially eject a main droplet and a satellite droplet having a volume smaller than that of the main droplet. The main droplet catcher is positioned between the nozzle hole and an ejection object so as to come into contact with the main droplet but not with the satellite droplet, to thereby catch the main droplet alone.

In the foregoing apparatus for ejecting droplets, when the pressure applicator applies pressure to the liquid reserved in the reservoir, the nozzle hole which communicates with the reservoir ejects droplets. The nozzle hole sequentially ejects the main droplet and the satellite droplet having a volume smaller than that of the main droplet. The main droplet catcher is positioned between the nozzle hole and the ejection object so as to come into contact with the main droplet but not with the satellite droplet. The main droplet is caught by the main droplet catcher, and therefore only the satellite droplet having the smaller volume can be ejected to the ejection object. As a result, a fine dot can be formed on the ejection object.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, certain preferred embodiments of the present invention will be described with reference to the accompanying drawings.

Figure 1:
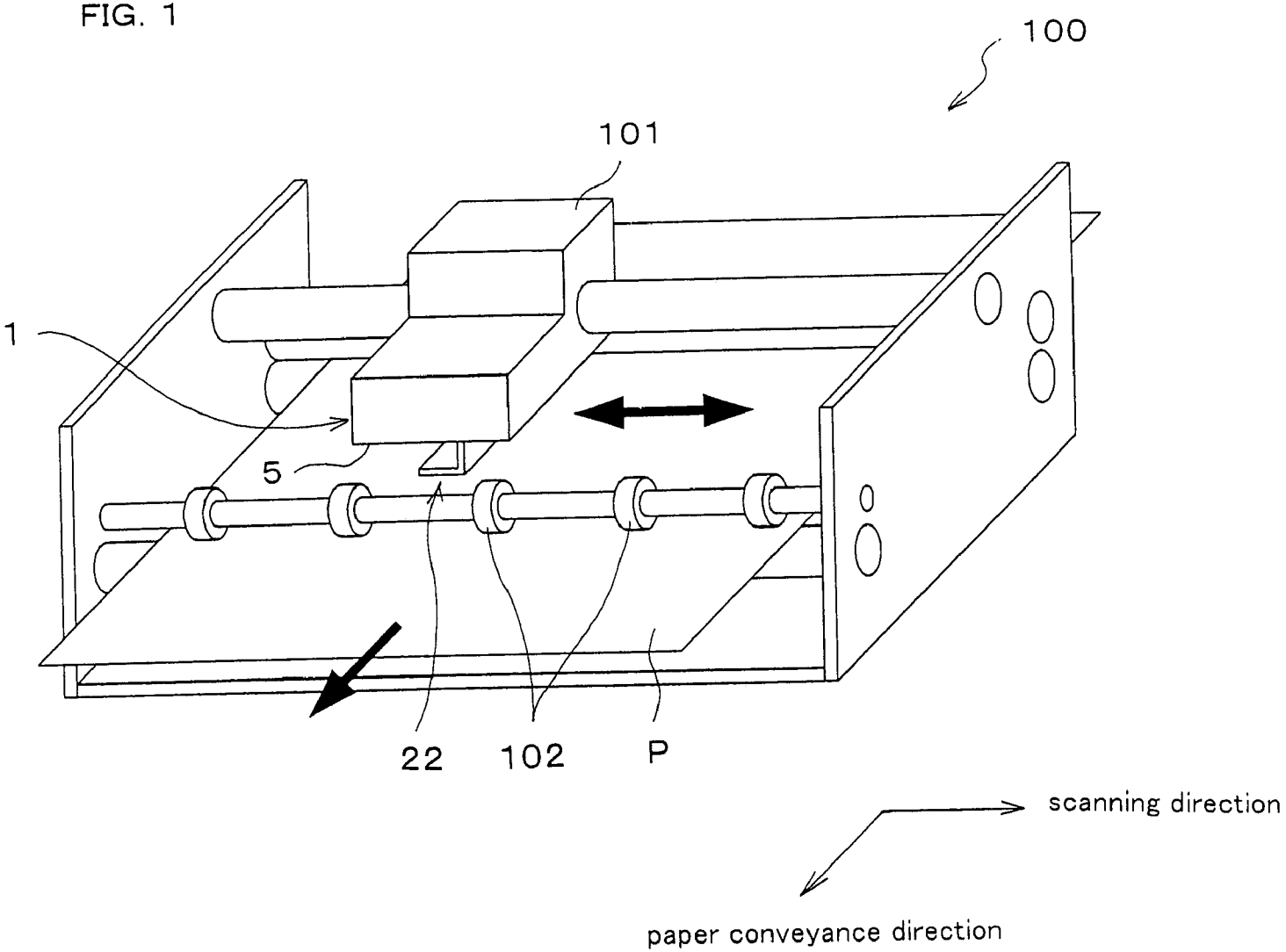
FIG. 1 schematically illustrates an ink-jet printer according to a first embodiment of the present invention.

A first embodiment of the present invention will firstly be described below. In the first embodiment, the present invention is applied to a serial-type ink-jet head for ejecting ink onto a recording sheet, which is adopted as an apparatus for ejecting droplets. Here a brief description will be given to an ink-jet printer 100 including an ink-jet head 1 of this embodiment. As illustrated in FIG. 1, the ink-jet printer 100 includes a carriage 101, an ink-jet head 1, and a conveyance roller 102. The carriage 101 is movable in a transverse direction in FIG. 1, that is, in a main scanning direction. The ink-jet head 1 is mounted on the carriage 101 and ejects ink to a recording sheet P. The conveyance roller 102 conveys the recording sheet P frontward in FIG. 1. The ink-jet head 1 moves in the main scanning direction together with the carriage 101, and ejects ink to the recording sheet P from an ejection opening of a nozzle hole which opens in a lower face of the ink-jet head 1 as an ink ejection face 5. The ink-jet head 1 thus performs recording on the recording sheet P which is then conveyed by the conveyance roller 102 frontward (i.e., in a paper conveyance direction) and discharged.

Figure 2:
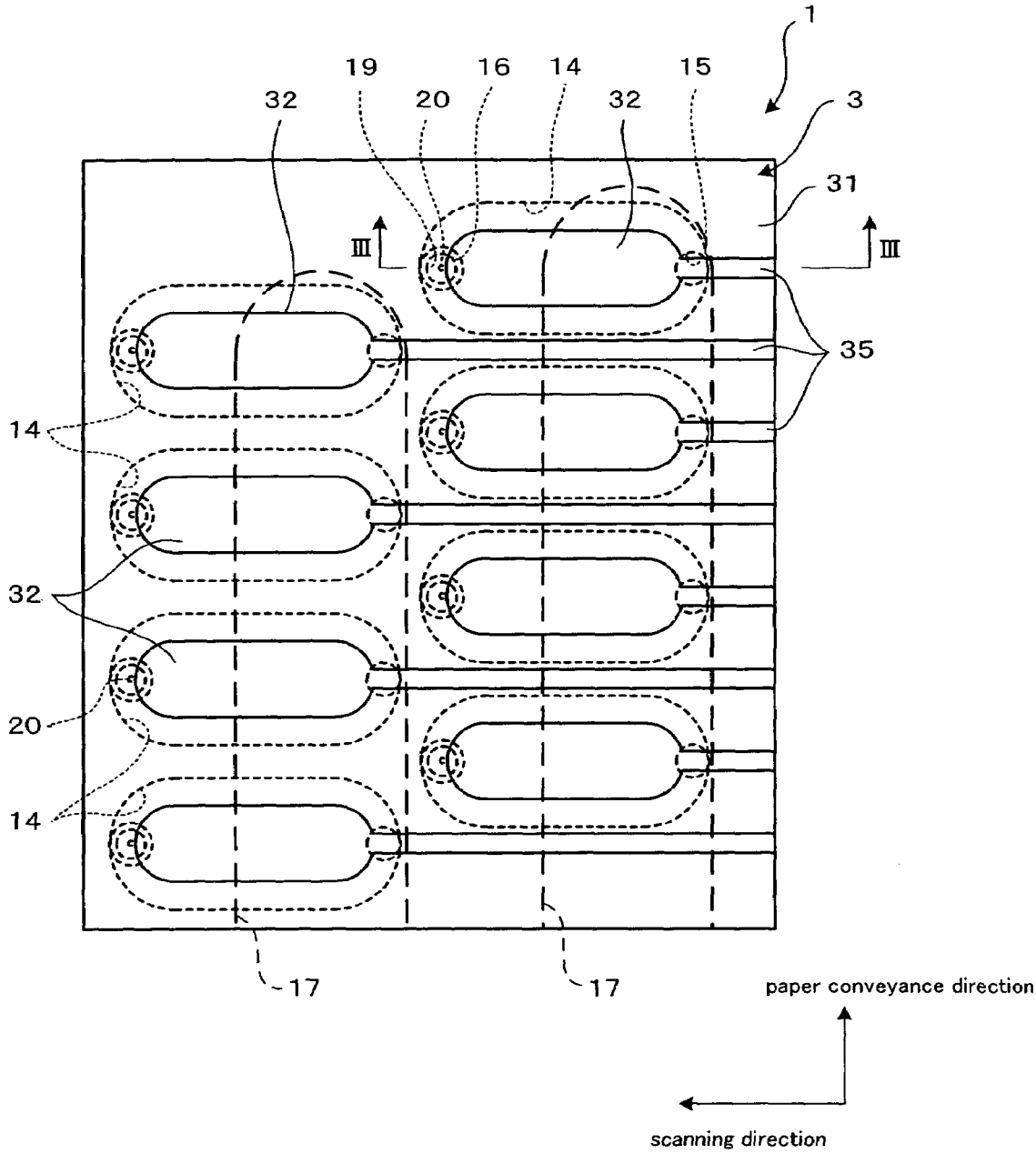
FIG. 2 is a local enlarged top view of an ink-jet head included in the ink-jet printer of FIG. 1.
Figure 3:
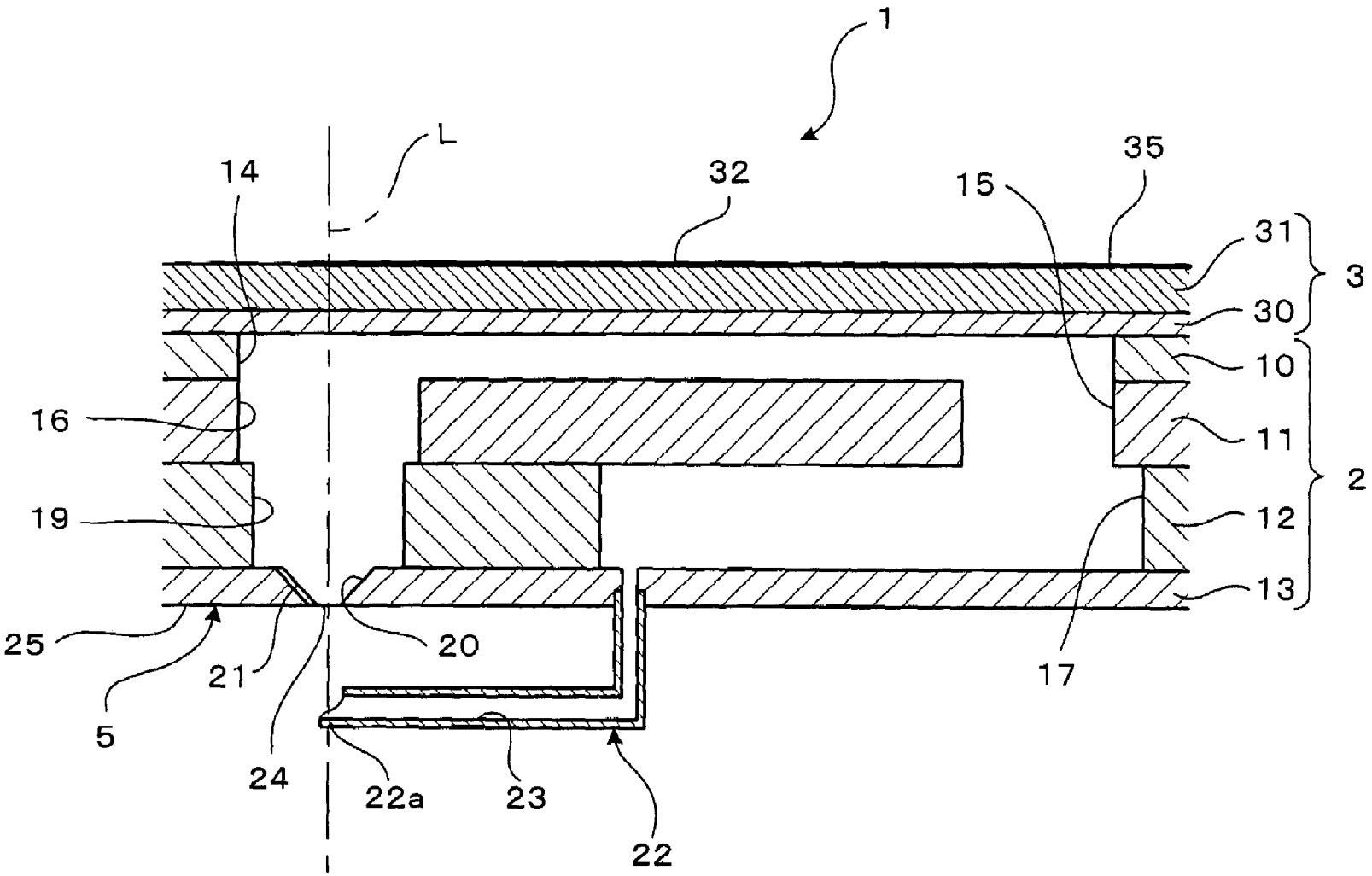
FIG. 3 illustrates a section taken along a line. III-III of FIG. 2.

Next, the ink-jet head 1 will be described in detail. As illustrated in FIGS. 2 and 3, the ink-jet head 1 includes a passage unit 2 and a piezoelectric actuator 3. In the passage unit 2, individual ink passages each corresponding to each pressure chamber 14 are formed. The piezoelectric actuator is bonded to an upper face of the passage unit 2.

The passage unit 2 will be described. As illustrated in FIG. 3, the passage unit 2 includes a cavity plate 10, a base plate 11, a manifold plate 12, and a nozzle plate 13. These four plates 10 to 13 are put in layers and bonded to one another. The cavity plate 10, the base plate 11, and the manifold plate 12 are plates made of stainless steel, in which a manifold 17, pressure chambers 14, communication holes 15, 16, 19, etc., all constituting the individual ink passages can easily be formed by means of an etching process. The nozzle plate 13 is made of a polymeric synthetic resin such as polyimide, etc., but the nozzle plate 13 as well as the aforementioned plates 10 to 12 may be made of a metallic material such as stainless steel, too.

Many pressure chambers 14 are formed through the cavity plate 10. The pressure chambers 14 open in a surface of the passage unit 2, that is, in a face to which a diaphragm 30 is bonded as will be described later. The pressure chambers 14, only eight of which are shown in FIG. 2, are arranged in a zigzag pattern along a plane. Each pressure chamber 14 has, in a plan view, a substantially elliptic shape with its longer axis being along the main scanning direction.

In the base plate 11, communication holes 15 and 16 are formed so as to overlap opposite lengthwise ends of each pressure chamber 14 in a plan view. In the manifold plate 12, manifold channels 17 extending along the paper conveyance direction (i.e., vertical direction in FIG. 2) are formed. In a plan view, each manifold channel 17 overlaps a right half of each pressure chamber in FIG. 2. The manifold channels 17 are supplied with ink from an ink tank (not illustrated) and thus always filled up with ink. In the manifold plate 12, further, communication holes 19 are formed so as to overlap the respective communication holes 16 in a plan view.

Figure 4A:
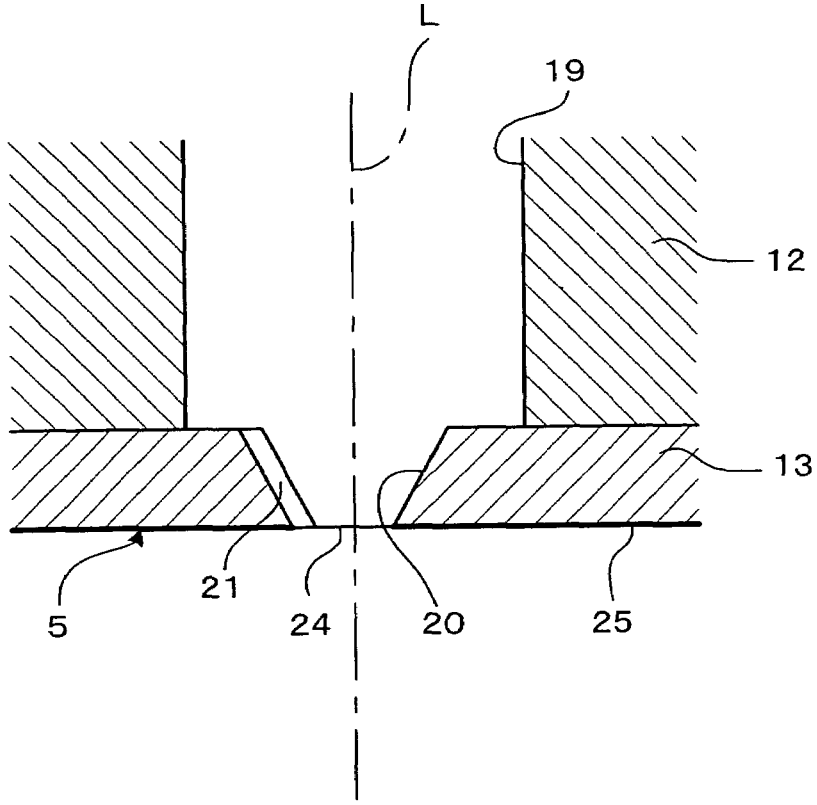
FIG. 4A is a local sectional view around a nozzle hole of FIG. 3.
Figure 4B:
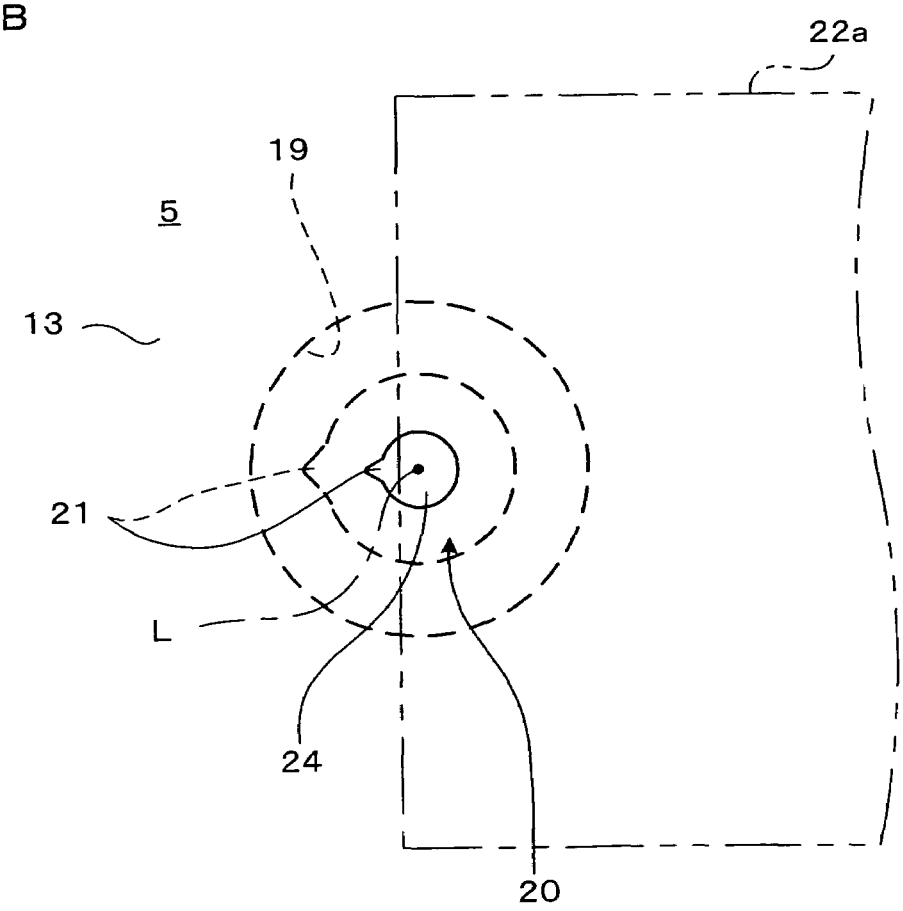
FIG. 4B illustrates a plane of the nozzle hole of FIG. 4A, as seen from a bottom side.

In the nozzle plate 13, nozzle holes 20 are formed such that, in a plan view, each of them overlaps a left end of each pressure chamber 14, that is, each of them overlaps the communication holes 16 and 19 in each pair. The nozzle holes 20 are formed by processing a substrate of a polymeric synthetic resin (e.g., polyimide, etc.) using excimer laser. The nozzle hole 20 has a circular shape when sectioned along a horizontal direction, and a tapered shape when sectioned along a vertical direction. As illustrated in FIGS. 4A and 4B, a notch 21 is formed at a periphery of each nozzle hole 20 in the nozzle plate 13, that is, formed on a sidewall defining each nozzle hole 20. The notch 21 is formed by cutting the periphery or the sidewall in a radial direction of the ejection opening 24 (at a left-side radius in FIG. 3). The notch 21 is formed continuously from an upper end to a lower end of the nozzle 20, that is, formed in the sidewall defining the nozzle hole 20 throughout its entire length along the axis of the nozzle hole 20. Accordingly, each of the both openings of the nozzle hole 20 including the notch 21, one of which opens in an upper face of the nozzle plate 13 bonded to the manifold plate 12 and the other of which opens in a lower face of the nozzle plate 13 serving as the ink ejection face 5, has such a shape that a part of its circular edge protrudes outward in the radial direction of the ejection opening 24 (i.e., leftward in FIGS. 3, 4A, and 4B) to be away from an axis L of the nozzle hole 20. As illustrated in FIGS. 3 and 4A, a highly liquid-repellent film 25 is formed throughout the ink ejection face 5 so that the neighborhood of each ejection opening 24 can be prevented from getting wet with ink.

Below the nozzle plate 13, a projection 22 having an L-shaped section is provided. An ink passage 23 which communicates with the manifold channel 17 is formed within the projection 22. The projection 22 having one end communicating with the manifold channel 17 extends downward therefrom, and further extends horizontally to substantially right under the ejection opening 24 of the nozzle hole 20 (i.e., extends left to right in FIG. 3). A front end 22*a* of the projection 22 has its lower part horizontally sticking out so that the lower part gets closer to the axis L of the nozzle hole 20 than an upper part does. The projection 22 will be described in more detail later.

As illustrated in FIG. 3, the manifold channel 17 communicates through the communication hole 15 with the pressure chamber 14, and further the pressure chamber 14 communicates through the communication holes 16 and 19 to the nozzle hole 20. Thus, an individual ink passage which extends from the manifold channel 17 through each pressure chamber 14 to a nozzle hole 20 is formed within the passage unit 2.

Next, the piezoelectric actuator 3 will be described. As illustrated in FIGS. 2 and 3, the piezoelectric actuator 3 includes the diaphragm 30, a piezoelectric layer 31, and individual electrodes 32. The diaphragm 30 has electroconductivity and is disposed on the surface of the passage unit 2. The piezoelectric layer 31 is disposed on a surface of the diaphragm 30 so that it extends over many pressure chambers 14. The individual electrodes 32 are formed on a surface of the piezoelectric layer 31 to correspond to the respective pressure chambers 14. The piezoelectric actuator 3 serves to change the volume of the pressure chamber to thereby apply pressure to ink contained in the pressure chamber 14.

The diaphragm 30 is a plate made of stainless steel having a substantially rectangular shape in a plan view. The diaphragm 30 is bonded to an upper face of the cavity plate 10 so that it closes openings of many pressure chambers 14. The diaphragm 30 is opposed to many individual electrodes 32, and serves as a common electrode that produces an electric field in the piezoelectric layer 31 disposed between the individual electrodes 32 and the diaphragm 31.

The diaphragm 31 is a solid solution of lead titanate and lead zirconate, and its base is a lead zirconate titanate (PZT) having ferroelectricity. The piezoelectric layer 31 can be formed by means of, e.g., an aerosol-deposition method (AD method) in which ultra-fine particles of a material are collided against each other at a high speed and deposited. In addition, a sol-gel method, a sputtering method, a hydrothermal method, a CVD (chemical vapor deposition) method, and the like can also be employed. Besides, in order to form the piezoelectric layer 31, a piezoelectric sheet obtained by burning a green sheet of PZT can be bonded to the surface of the diaphragm 30.

Each individual electrode 32 is made of a conductive material such as gold, and has an elliptic shape slightly smaller than the pressure chamber 14 in a plan view. As illustrated in FIG. 2, in a plan view, the individual electrode 32 overlaps a middle part of its corresponding pressure chamber 14. On the surface of the piezoelectric layer 31, a wiring portion 35 extends from one end of each individual electrode 32 (a right end in FIG. 2) in a direction along the longer axis of the individual electrode 32. The wiring portion 35 is electrically connected to a driver IC (not illustrated) which selectively supplies a drive voltage to a corresponding individual electrode 32.

Next, a function of the piezoelectric actuator 3 will be described. When a driver IC selectively supplies a drive voltage to an individual electrode 32, a potential of that individual electrode 32 which is disposed on the upper side of the piezoelectric layer 31 is differentiated from a potential of the diaphragm 30 as the common electrode which is disposed on the lower side of the piezoelectric layer 31 and kept at the ground potential. This causes a vertical electric field to occur at a portion of the piezoelectric layer 31 sandwiched between each individual electrode 32 and the diaphragm 30. Consequently, a portion of the piezoelectric layer 31 right under the individual electrode 32 which has been supplied with the drive voltage contracts in the horizontal direction which is perpendicular to the polarization occurring in the vertical direction. Such contraction of the piezoelectric layer 31 causes the diaphragm 30 to deform into a convex shape toward the pressure chamber 14. The volume of the pressure chamber 14 is thereby reduced to apply pressure onto ink contained in the pressure chamber 14, so that the ink is ejected from a nozzle hole 20 which communicate with the aforesaid pressure chamber 14.

The ejection of an ink droplet from the nozzle hole 20 will be described in detail with reference to FIGS. 5A to 5E. Here will be described an example in which a main droplet Ia is firstly ejected from the nozzle hole 20 and subsequently a satellite droplet Ib having a volume smaller than that of the main droplet Ia. However, depending on a design of the nozzle hole 20, a design of the individual ink passage within the passage unit 2, a condition for driving the piezoelectric actuator 3, and the like, it may be possible that a center part of the meniscus appearing in the ejection opening 24 of the nozzle hole 20 rapidly gets protruding upon starting an ejection operation and a front end of this protrusion gets separated and ejected as a satellite droplet Ib followed by an ejection of a main droplet Ia. In the present invention, either one of a main droplet Ia and a satellite droplet Ib can be ejected earlier than the other. In other words, the present invention does not depend on an ejection order of main and satellite droplets Ia and Ib.

Figure 5A:
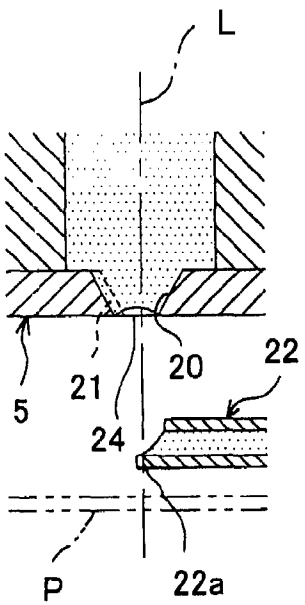
FIGS. 5A to 5E are views for explaining how an ink droplet is ejected from a nozzle hole.
Figure 5B:
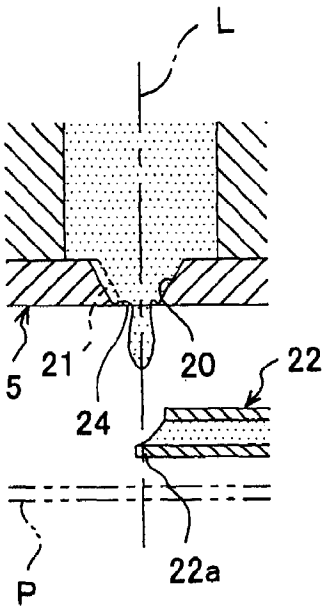

Referring to FIG. 5A, a meniscus appears in the vicinity of the ejection opening 24 of the nozzle hole 20. When, in this condition, the piezoelectric actuator 3 applies pressure to ink contained in the pressure chamber 14, the ink protrudes from the ejection opening 24 of the nozzle hole 20 as illustrated in FIG. 5B. The protruding ink is continuous to the nozzle hole 20. When a portion of the protruding ink which is in contact with the ejection opening 24 of the nozzle hole 20, that is, a tail It of the protruding ink is pulled in a direction opposite to a droplet-ejection direction (i.e., pulled upward in FIGS. 5A to 5E), the portion of the protruding ink except the tail It gets separated and is ejected as a main droplet Ia (see FIG. 5C) and then the tail It is ejected as a satellite droplet Ib (see FIG. 5D). The main droplet Ia has a volume of approximately several pl and the satellite droplet Ib has a volume of approximately 2 to 500 fl (femtoliter), for example.

The main droplet Ia flies downward along the axis L of the nozzle hole 20. As illustrated in FIG. 3, the projection 22 is provided below the nozzle plate 13. The projection 22 extends to substantially right under the ejection opening 24 of the nozzle hole 20. The front end 22*a* of the projection 22 has its lower part sticking out beyond the axis L of the nozzle hole 20. Therefore, the main droplet Ia is caught in the front end 22*a* of the projection 22, without reaching the recording sheet P.

Figure 5C:
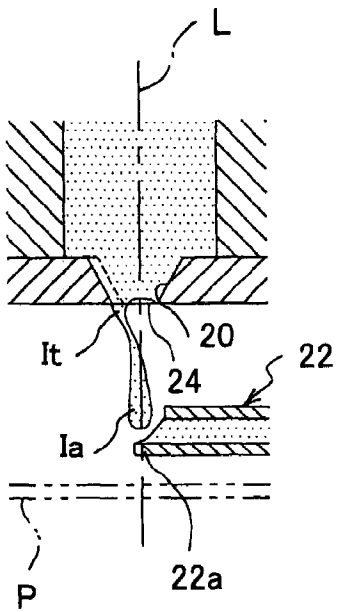
Figure 5D:
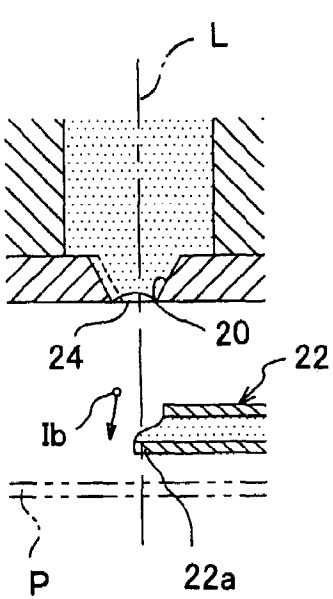
Figure 5E:
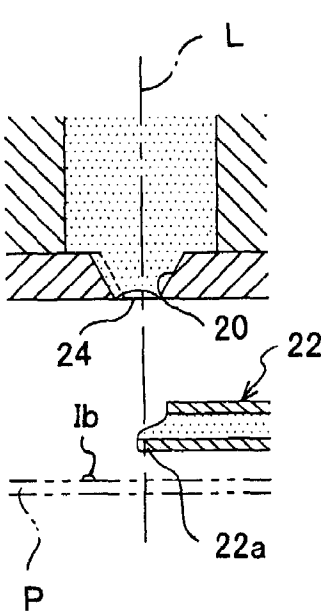

Since the notch 21 is provided, the satellite droplet Ib flies in a direction inclining away from the axis L (see FIG. 5D), which is different from the direction of flying of the main droplet Ia. To be more specific, the tail It is pulled into the notch 21 as illustrated in FIG. 5C. After the main droplet Ia is ejected, the tail It forms the satellite droplet Ib which flies from the notch 21 as a starting point as illustrated in FIG. 5D. Since the notch 21 locates opposite to the projection 22 across the axis L of the nozzle hole 20, the satellite droplet Ib flies away from the projection 22. Accordingly, the main droplet Ia and the satellite droplet Ib fly in different trajectories. The main droplet Ia is caught in the front end 22*a* of the projection 22, while the satellite droplet Ib flies away from the front end 22*a* and lands on the recording sheet P without being caught in the front end 22*a* of the projection 22, as illustrated in FIG. 5E.

Here, a specific example of the first embodiment will be described. In this embodiment, the pressure chamber 14 has a depth of 50 μm, a width (i.e., shorter diameter) of 250 μm, and a length (i.e., longer diameter) of 2.5 mm. The ejection opening 24 of the nozzle hole 20 has a diameter of 20 μm. The notch 21 has a width of 4 μm and a depth of 4 μm. Employed as the ink is water-based dye ink having a viscosity of 3.0 cP and a surface tension of 39 mN/m. Under these conditions, ink was ejected from the nozzle hole 20, and a main droplet Ia and a satellite droplet Ib thus ejected were measured. Measurement results are shown in TABLE 1.

As shown in TABLE 1, the main droplet Ia was caught in the front end 22*a* of the projection 22 which locates on the axis L, while the satellite droplet Ib landed on the recording sheet P without being caught, because a flying direction of the satellite droplet Ib inclined relative to the axis L.

As described above, in the ink-jet head 1 of the first embodiment, when the piezoelectric actuator 3 applies pressure to ink contained in a pressure chamber 14, a nozzle hole 20 which communicates with the aforesaid pressure chamber 14 ejects a droplet. The nozzle hole 20 sequentially ejects the main droplet Ia and the satellite droplet Ib having a volume smaller than that of the main droplet Ia. The projection 22 is positioned between the nozzle hole 20 and the recording sheet P so as to come into contact with the main droplet Ia but not with the satellite droplet Ib. The main droplet Ia is caught by the projection 22, and therefore only the satellite droplet Ib having the smaller volume is ejected to the recording sheet P. As a result, a fine dot can be formed on the recording sheet P.

The notch 21 formed in the nozzle plate 13 allows the satellite droplet Ib to fly in a trajectory different from the trajectory of the main droplet Ia. This can more ensure that the main droplet Ia is caught by the projection 22 with the satellite droplet Ib alone landing on the recording sheet P.

Further, the trajectory of the satellite droplet Ib can be differentiated from the trajectory of the main droplet Ia by means of forming the notch 21 in the sidewall defining the nozzle hole 20, which is merely a simple configuration. This is advantageous from the viewpoint of a manufacturing cost.

The notch 21 is formed in the sidewall defining the nozzle hole 20 throughout its entire length along the axis of the nozzle hole 20. This is advantageous from the viewpoint of a manufacturing process. To be more specific, the notch 21 can easily be formed by performing a press working, etc., or alternatively by forming a mask pattern on the nozzle plate 13 which is then irradiated with excimer laser, both without a need of any subsequent processing.

As illustrated in FIG. 3, moreover, the ink passage 23 formed within the projection 22 communicates through the manifold channel 17 to the pressure chamber 14. Accordingly, when, after an ink ejection, ink is supplied from the manifold channel 17 to the pressure chamber 14, ink of the main droplet Ia which has been caught by the projection 22 flows through the ink passage 23 and the manifold channel 17 into the pressure chamber 14 so that the ink is ejected again from the nozzle hole 20. Therefore, ink can be effectively used without a waste.

Figure 6A:
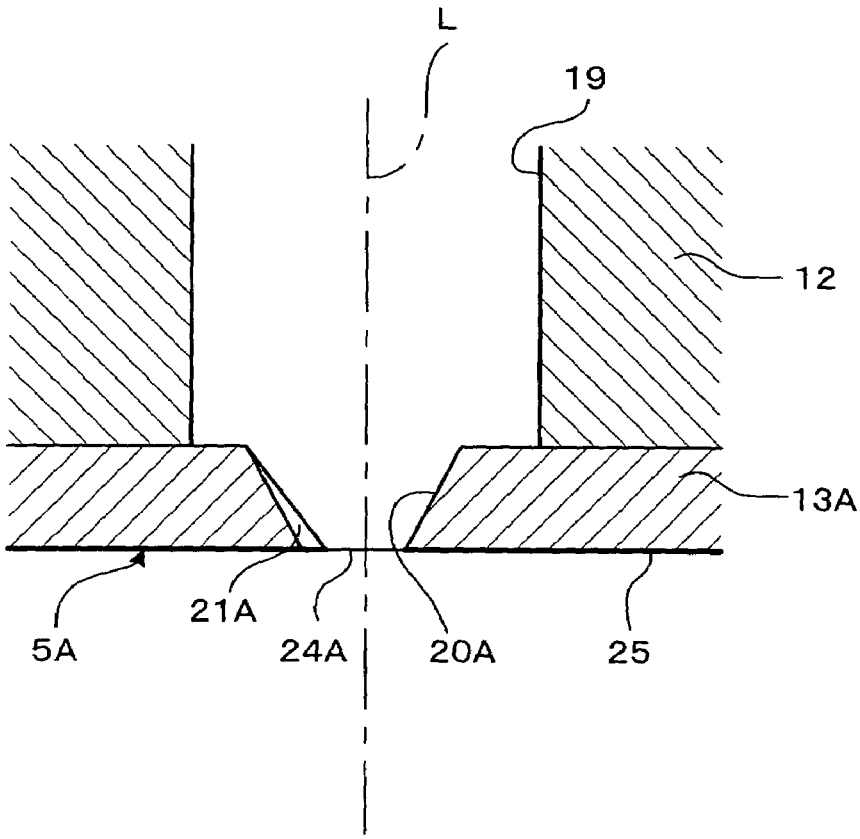
FIG. 6A is a local sectional view around a nozzle hole according to a first modification of the first embodiment.
Figure 6B:
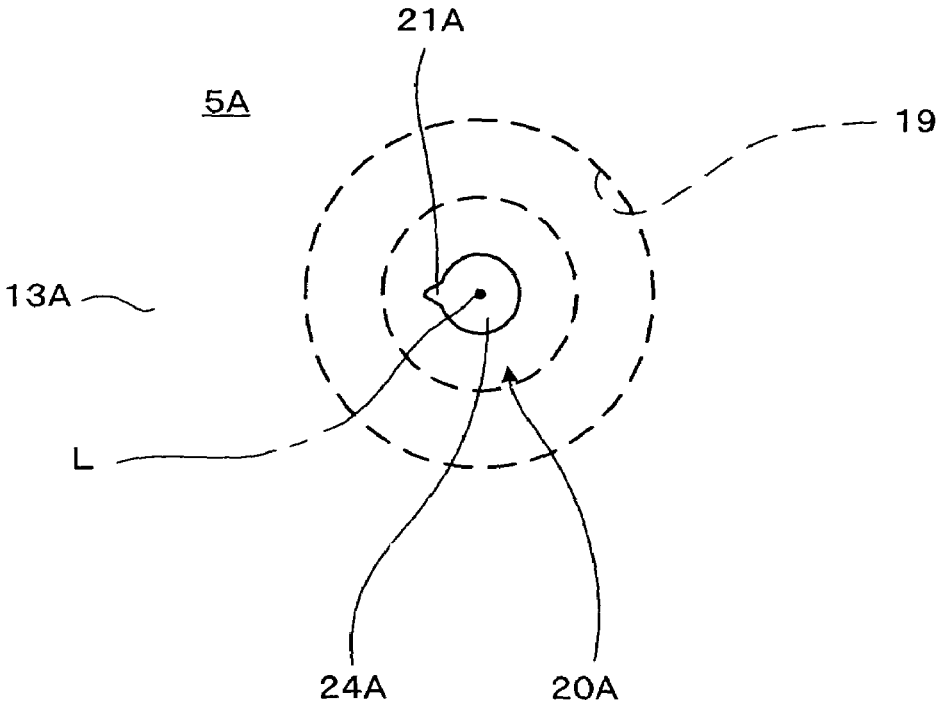
FIG. 6B illustrates a plane of the nozzle hole of FIG. 6A, as seen from a bottom side.

A shape of the notch which is formed in the sidewall defining the nozzle hole is not limited to the above-described one in the first embodiment. It is not always necessary to form the notch continuously from the lower end to the upper end of the nozzle hole. For example, a notch 21A according to a first modification of the first embodiment, as illustrated in FIGS. 6A and 6B, may also be acceptable. The notch 21A gradually gets narrowed upward from a periphery of an ejection opening 24A which locates at a lower end of a nozzle hole 20A and opens in an ink ejection face 5A, so that the notch 21A may not reach an upper face of the nozzle plate 13A. Thus, the notch may have various shapes in addition to the illustrated one, as long as it is formed at the periphery of the ejection opening of the nozzle hole opening in the ink ejection face.

Figure 7A:
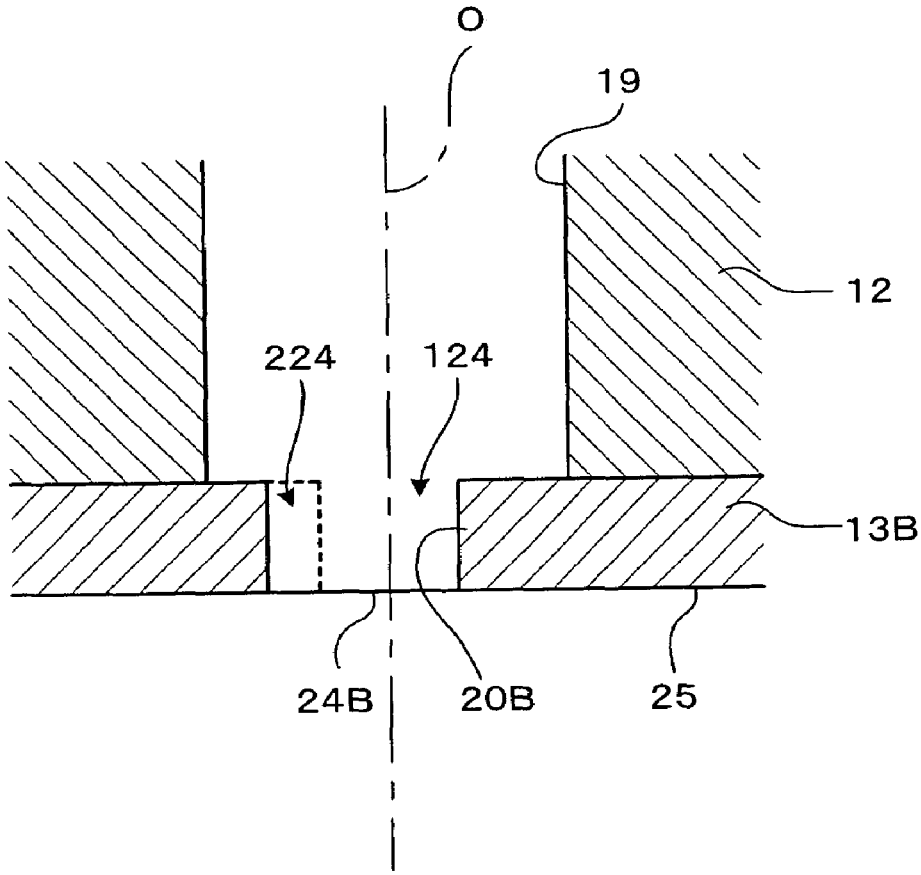
FIG. 7A is a local sectional view around a nozzle hole according to a second modification of the first embodiment.
Figure 7B:
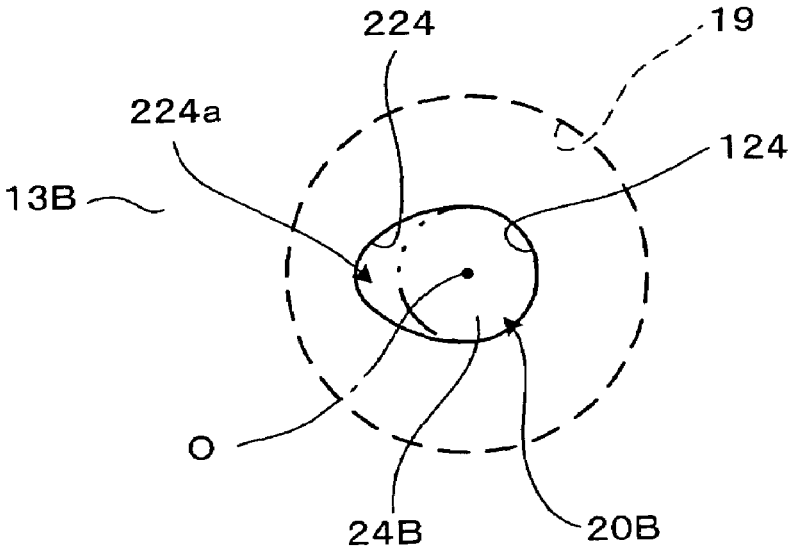
FIG. 7B illustrates a plane of the nozzle hole of FIG. 7A, as seen from a bottom side.

Further, according to a second modification of the first embodiment as illustrated in FIGS. 7A and 7B, a nozzle hole 20B whose ejection opening 24B has an ovoid-shaped periphery may be formed in the nozzle plate 13B. In this case as well, a satellite droplet Ib and a main droplet Ia which fly in different trajectories are ejected from the ejection opening 24B. A shape of the ejection opening 24B is like a combination of a complete circle 124 and a portion 224 bulging out from the complete circle 124 (which more specifically is a portion having a shape of a sine-wave within 0 to 180 degrees). A top 224*a* of the bulging portion 224 has a curvature larger than a curvature of the complete circle 124.

The above-described nozzle hole 20, 20A having the notch 21, 21A formed in the sidewall (see FIGS. 4A, 4B; and FIGS. 6A, 6B) and the nozzle hole 20B of this modification whose ejection opening 24B has an ovoid-shaped periphery (see FIGS. 7A and 7B) have the following similarities: an ejection opening has a protrusion formed thereat; the protrusion has a distance from a center of the ejection opening except the protrusion larger than that of the ejection opening except the protrusion; and a periphery of the protrusion has a curvature larger than that of a periphery of the ejection opening except the protrusion. Here, with respect to the nozzle hole 20, 20A having the notch 21, 21A formed in the sidewall, the "center of the ejection opening except the protrusion" means the axis L of the nozzle hole 20, 20A. With respect to the nozzle hole 20B of this modification whose ejection opening 24B has the ovoid-shaped periphery, the "center of the ejection opening except the protrusion" means a center O of the complete circle 124. With respect to both of the nozzle hole 20, 20A and 20B, the "remaining portion" means an inside of the complete circle in the above example. When these conditions are satisfied, the satellite droplet Ib and the main droplet Ia which fly in different trajectories can be ejected from the ejection opening. Therefore, as long as these conditions are satisfied, an ejection opening having any other shape can be employed in order to eject the satellite droplet Ib and the main droplet Ia which fly in different trajectories.

Figure 8A:
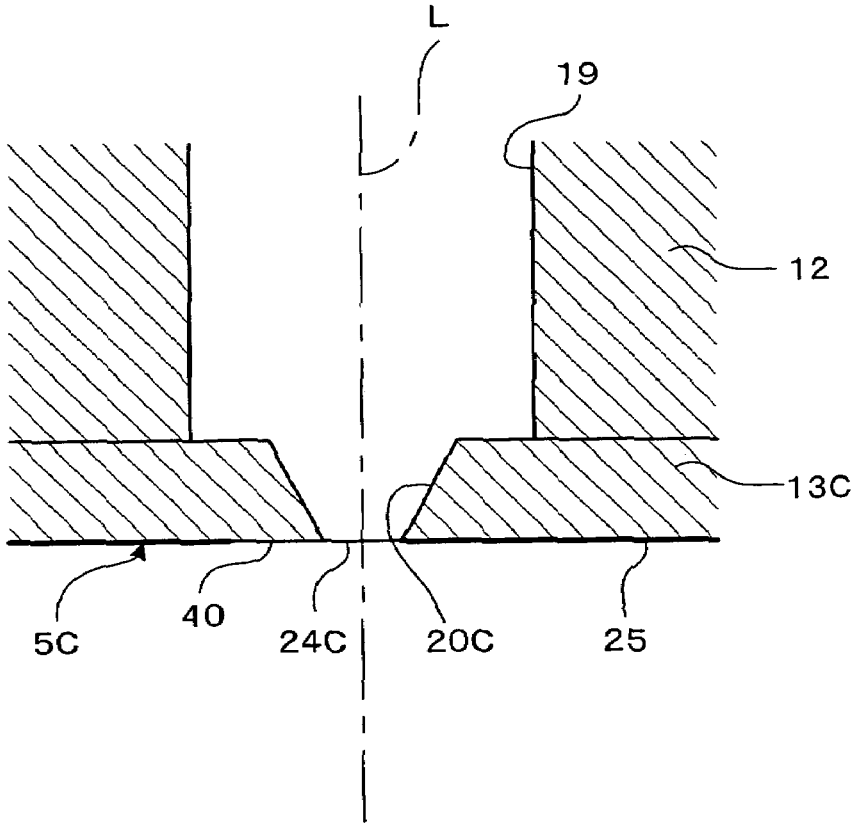
FIG. 8A is a local sectional view around a nozzle hole according to a third modification of the first embodiment.
Figure 8B:
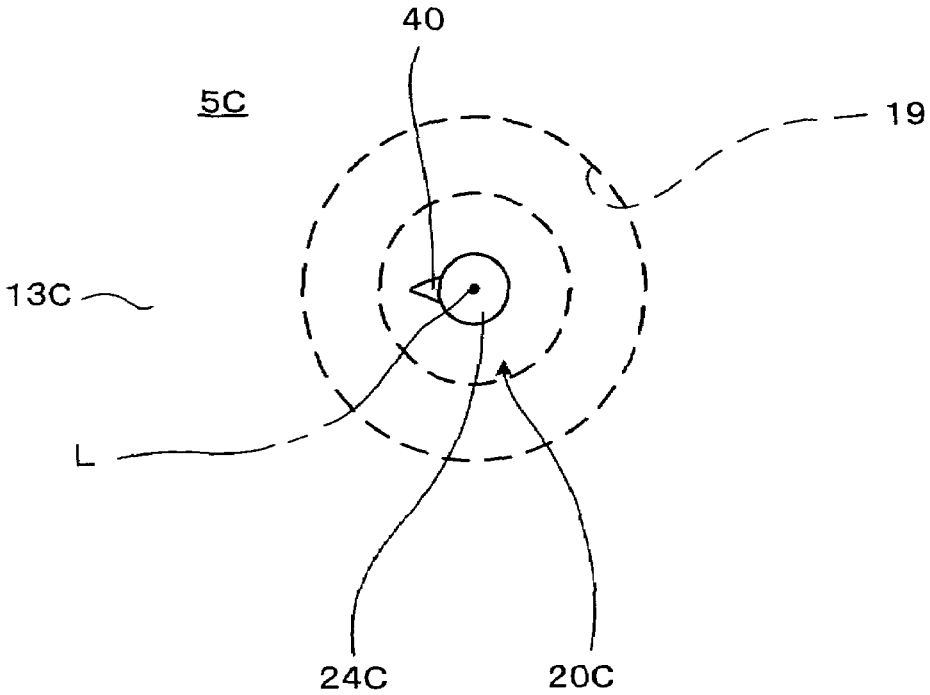
FIG. 8B illustrates a plane of the nozzle hole of FIG. 8A, as seen from a bottom side.

In order to differentiate the trajectory of the satellite droplet Ib from the trajectory of the main droplet Ia, other methods can be adopted instead of providing a protrusion at the ejection opening by forming the periphery of the ejection opening into the ovoid-shape or forming the notch in the sidewall defining the nozzle hole. For example, a nozzle hole 20C illustrated in FIGS. 8A and 8B may also be acceptable. The nozzle hole 20C has a circular shape when sectioned along a horizontal direction and a tapered shape when sectioned along a vertical direction, which is the same as the shape of the nozzle hole 20 of the first embodiment illustrated in FIGS. 4A and 4B. However, the nozzle hole 20C differs from the nozzle hole 20 of the first embodiment in that the notch 21 is not formed in a sidewall defining the nozzle hole 20C and instead a part 40 where the liquid-repellent film 25 does not present are provided on the ink ejection face 5C of the nozzle plate 13C. As illustrated in FIG. 8B, the part 40 where the liquid-repellent film does not present has a tapered shape extending from an ejection opening 24C of the nozzle hole 20C in a radial direction of the ejection opening 24C. In order to provide the part 40 where the liquid-repellent film does not present, the liquid-repellent film 25 is formed on a whole face of the ink ejection face 5C and then the liquid-repellent film 25 is partially removed. Alternatively, using a resist processing, etc., the liquid-repellent film 25 is formed only on an area other than the part 40 where the liquid-repellent film does not present. The part 40 where the liquid-repellent film does not present gets more wettable by ink than a portion where the liquid-repellent film 25 presents. Therefore, in an ejection of a main droplet Ia from the nozzle hole 20C, the tail It is pulled toward the part 40 where the liquid-repellent film does not present. Thus, the tail It forms a satellite droplet Ib which flies from, as a starting point, the part 40 where the liquid-repellent film does not present in a direction inclining away from the axis L. In the example illustrated in FIGS. 8A and 8B, therefore, the trajectory of the satellite droplet Ib can be differentiated from the trajectory of the main droplet Ia by means of providing the part 40 where the liquid-repellent film does not present, which is merely a simple configuration. This is advantageous from the viewpoint of a manufacturing cost.

Next, a second embodiment of the present invention will be described. Here, the same members as those of the first embodiment will be denoted by the common reference numerals without their descriptions.

Figure 9:
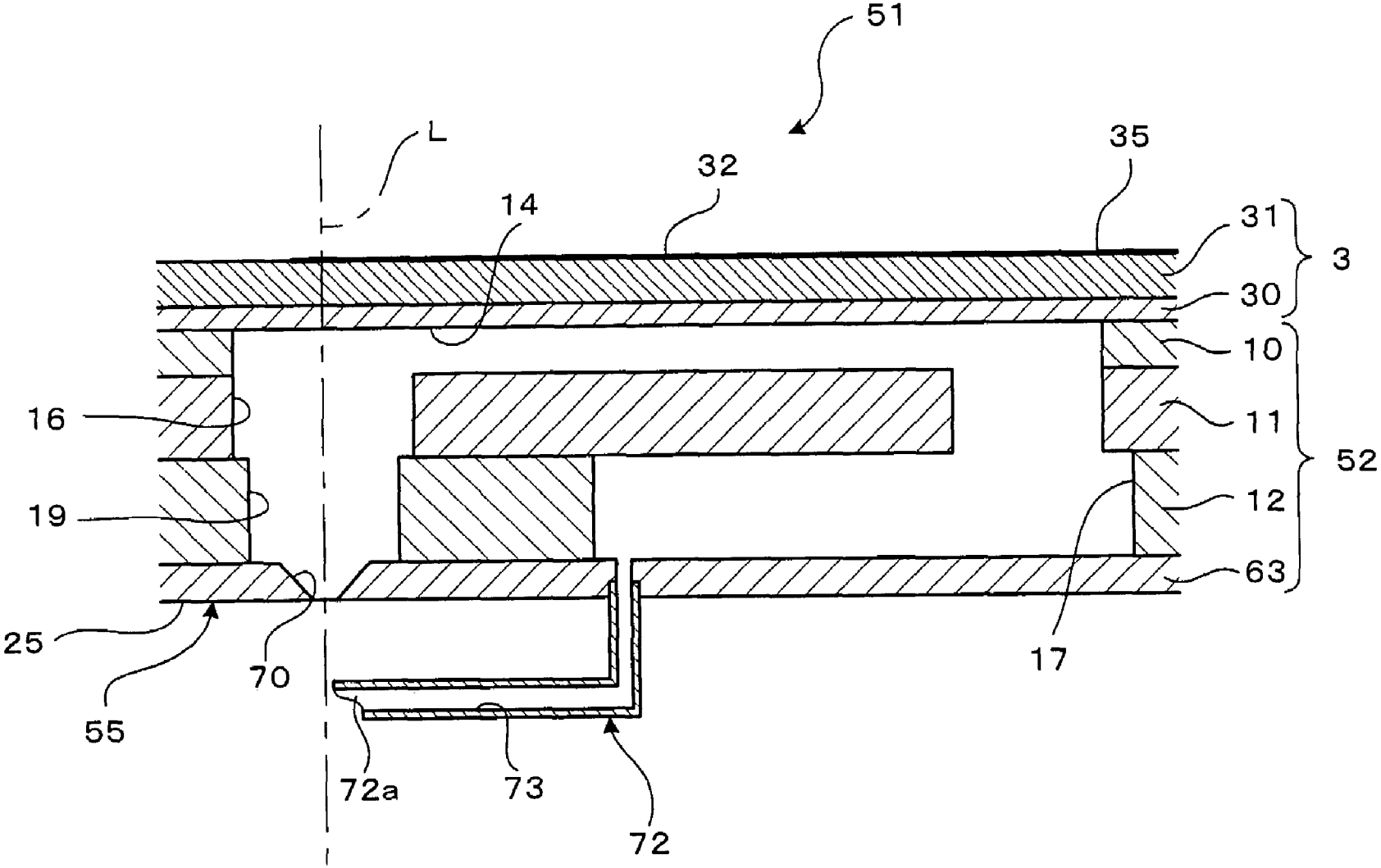
FIG. 9 corresponds to FIG. 3, and illustrates a section of an ink-jet head according to a second embodiment of the present invention.

As illustrated in FIG. 9, a passage unit 52 of an ink-jet head 51 of this embodiment includes a cavity plate 10, a base plate 11, a manifold plate 12, and a nozzle plate 63. Among these four plates, only the nozzle plate 63 is not the same as the corresponding plates of the first embodiment.

Figure 10A:
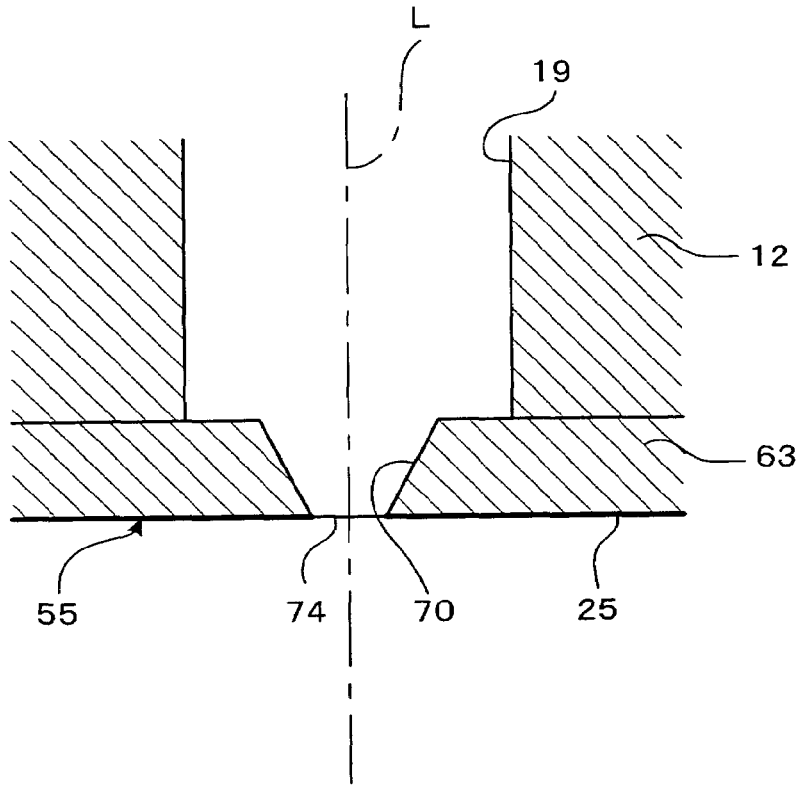
FIG. 10A is a local sectional view around a nozzle hole of FIG. 9.
Figure 10B:
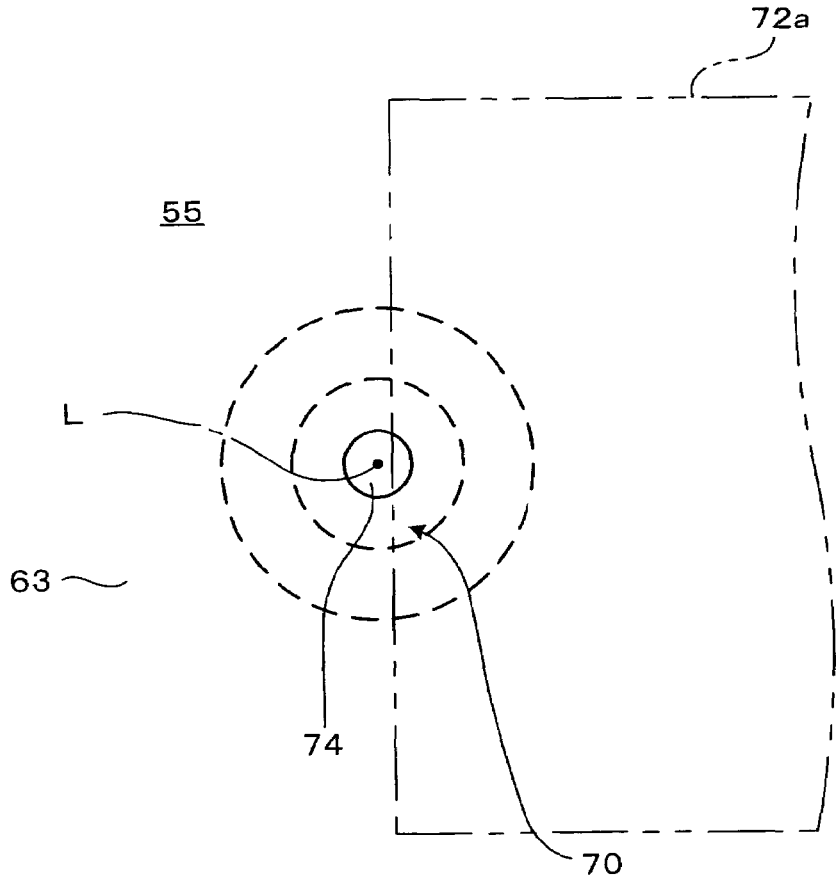
FIG. 10B illustrates a plane of the nozzle hole of FIG. 10A, as seen from a bottom side.

As illustrated in FIGS. 10A and 10B, the nozzle hole 70 formed in the nozzle plate 63 has a circular shape when sectioned along a horizontal direction and a tapered shape when sectioned along a vertical direction, which is the same as the shape of the nozzle hole 20 of the first embodiment illustrated in FIGS. 4A and 4B. However, the nozzle hole 70 differs from the nozzle hole 20 of the first embodiment in that the notch 21 is not formed in a sidewall defining the nozzle hole 70.

As illustrated in FIG. 9, a projection 72 provided below the nozzle plate 63 is different from the projection 22 of the first embodiment. A front end 72*a* of the projection 72 has a slanted shape so as to get away from an axis L of the nozzle hole 70 at a more downstream in the droplet-ejection direction. That is, in the first embodiment the front end 22*a* of the projection 22 has its lower part horizontally sticking out so that the lower part gets closer to the axis L of the nozzle hole 20 than an upper part does, whereas in this embodiment the front end 72*a* of the projection 72 has its upper part horizontally sticking out so that the upper part gets closer to the axis L of the nozzle hole 70 than a lower part does. The projection 72 extends to substantially right under the ejection opening 74 which opens in a lower face of the nozzle plate 63 as an ink ejection face 55. An ink passage 73 which communicates with a manifold channel 17 is formed within the projection 72.

As illustrated in FIG. 10B, when seen in a direction opposite to the ejection direction, the upper part of the front end 72*a* of the projection 72 partially overlaps the ejection opening 74 of the nozzle hole 70 but does not go beyond the axis L of the nozzle hole 70. Specifically, the front end 72*a* is positioned so as to partially overlap the main droplet Ia which flies downward along the axis L of the nozzle hole 70 but not to overlap the satellite droplet Ib. This arrangement can be achieved because the satellite droplet Ib has a very small diameter and has a volume much smaller than a volume of the main droplet Ia (e.g., a few tenths of the volume of the main droplet Ia, for example).

Figure 11A:
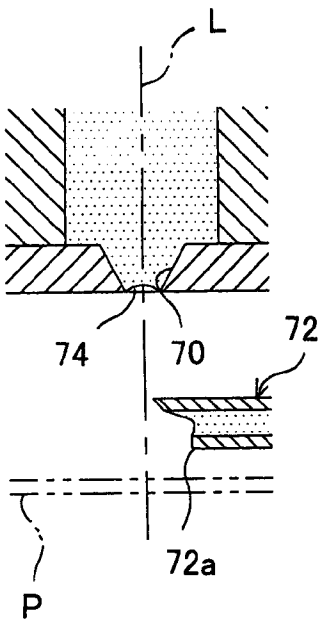
FIGS. 11A to 11E are views for explaining how an ink droplet is ejected from a nozzle hole.
Figure 11B:
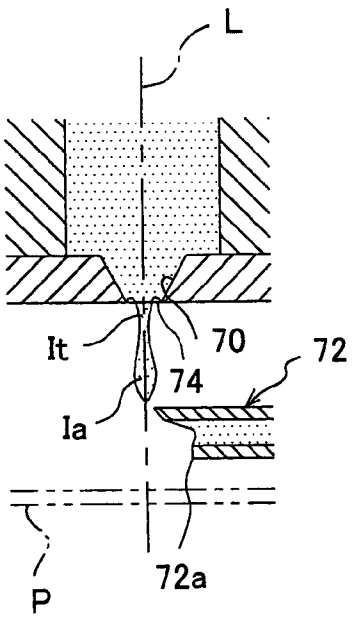

The ejection of an ink droplet from the nozzle hole 70 will be described in detail with reference to FIGS. 11A to 11B. Referring to FIG. 11A, a meniscus appears in the vicinity of the ejection opening 74 of the nozzle hole 70. When, in this condition, a piezoelectric actuator 3 applies pressure to ink contained in a pressure chamber 14, the ink protrudes from the ejection opening 74 of the nozzle hole 70 in the same manner as illustrated in FIG. 5B. When a tail It of ink is pulled in a direction opposite to a droplet-ejection direction (i.e., pulled upward in FIGS. 11A to 11E), the portion of the ink except the tail It gets separated and is ejected as a main droplet Ia (see FIG. 11B) and then the tail It is ejected as a satellite droplet Ib (see FIG. 11C).

Both the main droplet Ia and the satellite droplet Ib fly downward along the axis L of the nozzle hole 70. In this embodiment, differently from in the first embodiment, the notch 21 is not formed and therefore a trajectory of the satellite droplet Ib does not incline relative to the axis L but is parallel to the axis L. Therefore, the main droplet Ia and the satellite droplet Ib fly in the same trajectory.

Figure 11C:
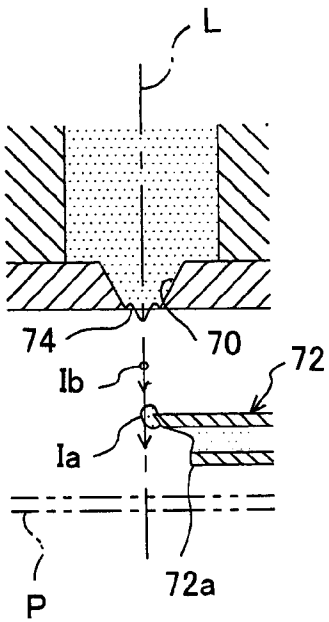
Figure 11D:
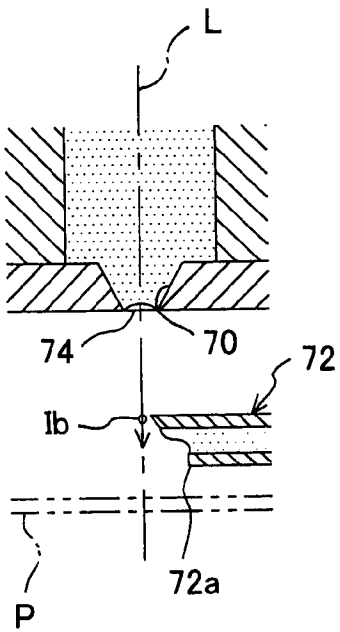
Figure 11E:
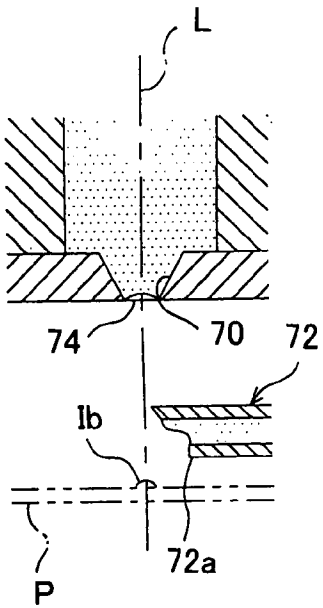

Although the main droplet Ia and the satellite droplet Ib fly in the same trajectory, they have different diameters. As described above, the front end 72*a* of the projection 72 is positioned so as to partially overlap the main droplet Ia having the larger volume but not to overlap the satellite droplet Ib having the smaller volume. Accordingly, as illustrated in FIG. 11C, the main droplet Ia is caught in the front end 72*a* of the projection 72, without reaching the recording sheet P. On the other hand, the satellite droplet Ib lands on the recording sheet P without being caught in the front end 72*a* of the projection 72, as illustrated in FIGS. 11D and 11E.

In this embodiment, the front end 72*a* of the projection 72 has the slanted shape so as to get away from the axis L of the nozzle hole 70 at the more downstream in the droplet-ejection direction. Due to this configuration, the main droplet Ia is hitched and caught by the front end 72*a* of the projection 72, and then moves from an upper side to a lower side of the front end 72*a* to thereby get away from the axis L of the nozzle hole 70. This can prevent the main droplet Ia from interfering the subsequently-ejected satellite droplet Ib.

Here, a specific example of the second embodiment will be described. In this embodiment, the pressure chamber 14 has a depth of 50 μm, a width (i.e., shorter diameter) of 250 μm, and a length (i.e., longer diameter) of 2.5 mm. The ejection opening 74 of the nozzle hole 70 has a diameter of 20 μm. Employed as the ink is water-based dye ink having a viscosity of 3.0 cP and a surface tension of 39 mN/m. Under these conditions, ink was ejected from the nozzle hole 70, and a main droplet Ia and a satellite droplet Ib thus ejected were measured. Measurement results are shown in TABLE 2.

As shown in TABLE 2, both the main droplet Ia and the satellite droplet Ib flied along the axis L of the nozzle hole 70, but a diameter of the satellite droplet Ib was not more than ⅓ of a diameter of the main droplet Ia and therefore the projection 72 caught the main droplet Ia alone without catching the satellite droplet Ib. Thus, only the satellite droplet Ib landed on the recording sheet P.

The projection 72 is preferably positioned such that its front end 72*a* is away from the satellite droplet Ib as much as possible and at the same time it comes into slight contact with the main droplet Ia. To this end, it is desired that the ejection of the main droplet Ia and the satellite droplet Ib should be observed for measuring their diameters in advance and a position of the front end 72*a* should be determined accordingly.

As described above, in the ink-jet head 51 of the second embodiment, similarly in the first embodiment, only the satellite droplet Ib having the smaller volume lands on the recording sheet P, so that a fine dot can be formed on the recording sheet P. Further, in this embodiment, the notch 21 as in the first embodiment (see FIGS. 4A and 4B) is not formed in the sidewall defining the nozzle hole 70. Therefore, ejection of an ink droplet from the nozzle hole 70 can be stabilized. This can improve print quality.

Next, a third embodiment of the present invention will be described. Here, the same members as those of the first and second embodiments will be denoted by the common reference numerals without their descriptions.

Figure 12:
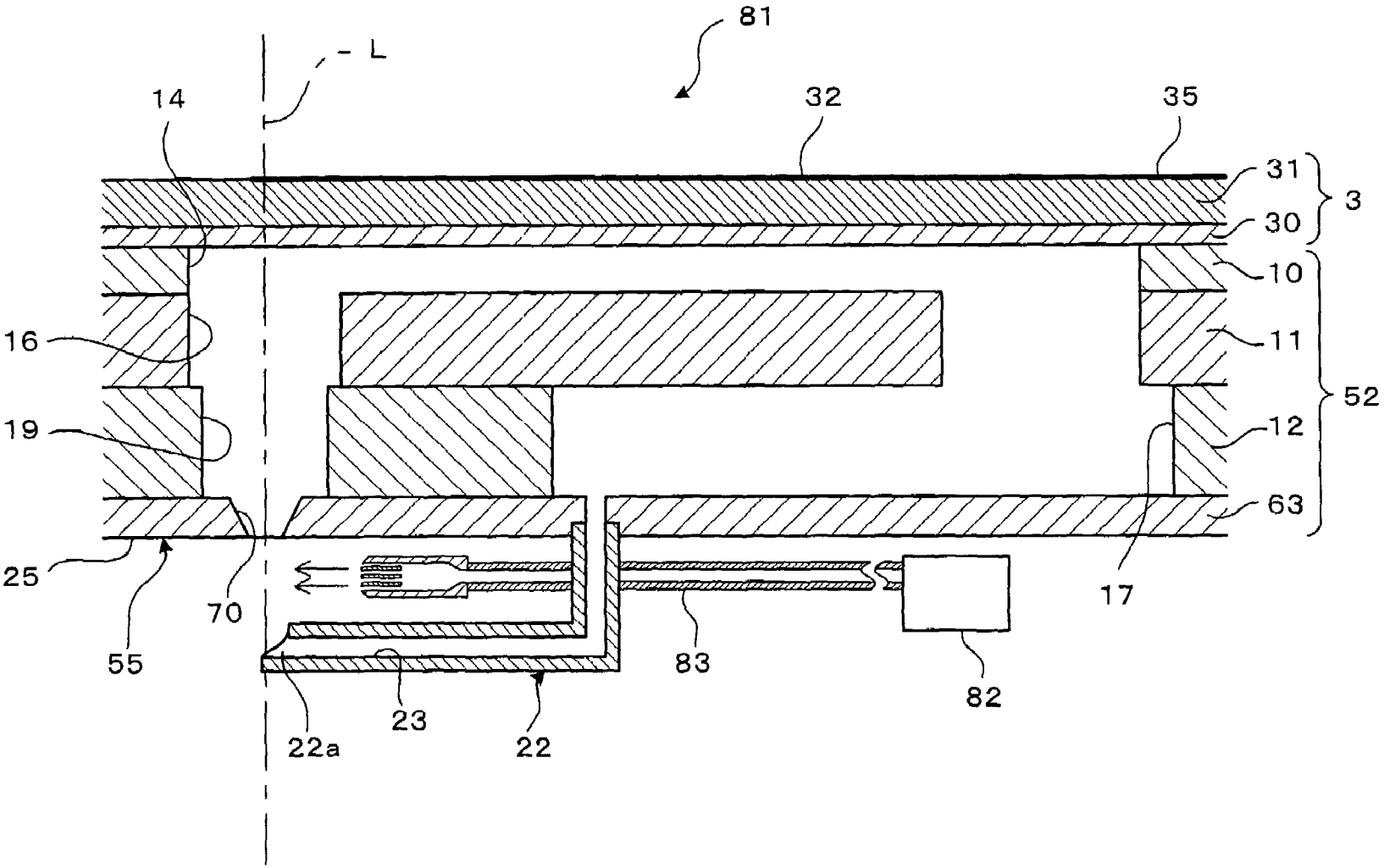
FIG. 12 corresponds to FIG. 3, and illustrates a section of an ink-jet head according to a third embodiment of the present invention.

In an ink-jet head 81 of the third embodiment, as illustrated in FIG. 12, a passage unit 52 is the same as that of the second embodiment, and a projection 22 provided below the nozzle plate 63 is the same as that of the first embodiment.

In this embodiment, a blower tube 83 connected to a blower 82 is further provided below the nozzle plate 63. The blower tube 83 is disposed between the nozzle plate 63 and the horizontal part of the projection 22, and extends horizontally along a plane of the nozzle plate 63. A front end of the blower tube 83 is more away from the axis L of the nozzle hole 70 than the front end 22*a* of the projection 22 is. The blower tube 83 blows air to an ink droplet ejected from the nozzle hole 70.

Figure 13A:
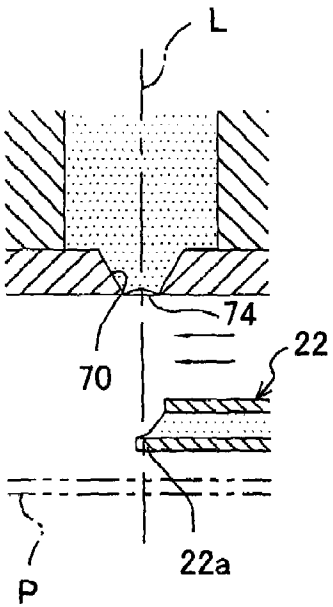
FIGS. 13A to 13E are views for explaining how an ink droplet is ejected from a nozzle hole.
Figure 13B:
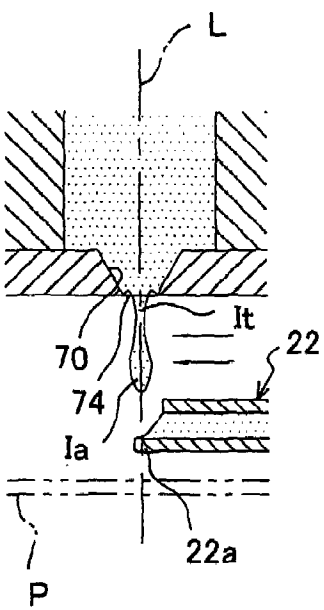
Figure 13C:
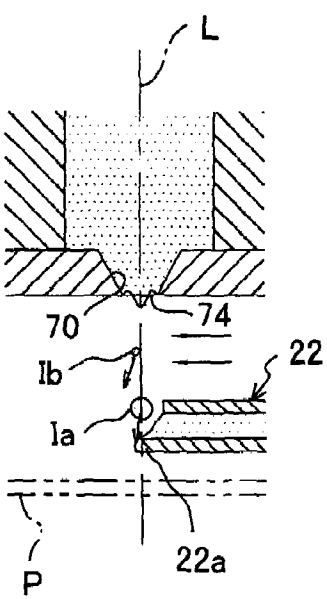

The ejection of an ink droplet from the nozzle hole 70 will be described in detail with reference to FIGS. 13A to 13B. Referring to FIG. 13A, a meniscus appears in the vicinity of an ejection opening 74 of the nozzle hole 70. When, in this condition, a piezoelectric actuator 3 applies pressure to ink contained in a pressure chamber 14, the ink protrudes from the ejection opening 74 of the nozzle hole 70 in the same manner as illustrated in FIG. 5B. When a tail It of ink is pulled in a direction opposite to a droplet-ejection direction (i.e., pulled upward in FIGS. 13A to 13E), the portion of the ink except the tail It gets separated and is ejected as a main droplet Ia (see FIG. 13B) and then the tail It is ejected as a satellite droplet Ib (see FIG. 13C)

Both the main droplet Ia and the satellite droplet Ib fly downward along the axis L of the nozzle hole 70. In this embodiment, differently from in the first embodiment, the notch 21 is not formed and therefore a trajectory of the satellite droplet Ib does not incline relative to the axis L but is parallel to the axis L. Therefore, the main droplet Ia and the satellite droplet Ib fly in the same trajectory.

The main droplet Ia and the satellite droplet Ib ejected from the nozzle hole 70 are affected by wind pressure of air which is blown out from the blower tube 83 and travels from a right side of FIG. 13. Trajectories of the main and satellite droplets Ia and Ib are changed accordingly. The main droplet Ia and the satellite droplet Ib have different diameters. Since air resistance is proportional to a square of a diameter and inertia is proportional to a cube of a diameter, change of the trajectory of the main droplet Ia and change of the trajectory of the satellite droplet Ib, which are caused by the wind pressure of the air blown out from the blower tube 83, are different in their degree. Specifically, the trajectory of the main droplet Ia having the larger diameter is changed to a small degree, and therefore the main droplet Ia flies substantially along the axis L of the nozzle hole 70. On the other hand, the trajectory of the satellite droplet Ib having the smaller diameter is changed to a large degree, and therefore the trajectory of the satellite droplet Ib relatively largely inclines against the axis L of the nozzle hole 70 (see FIG. 13C).

Figure 13D:
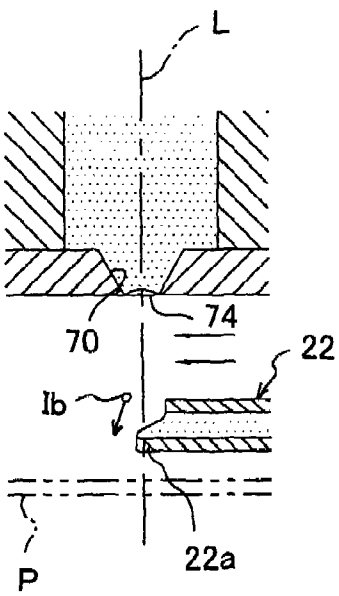
Figure 13E:
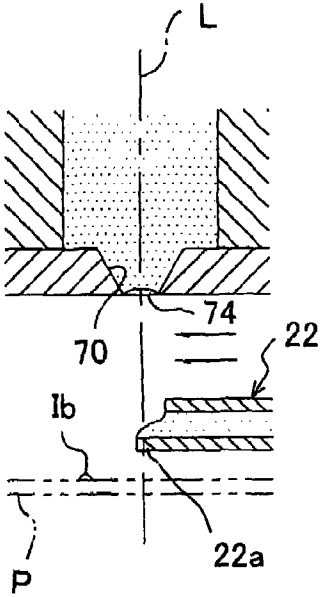

Consequently, as illustrated in FIG. 13D, the main droplet Ia is caught in the front end 22*a* of the projection 22, while the satellite droplet Ib lands on the recording sheet P without being caught by the projection 22 because the trajectory of the satellite droplet Ib is largely deviated leftward by the wind pressure of the air which has been blown out from the blower tube 83.

Here, a specific example of the third embodiment will be described. In this embodiment, the pressure chamber 14 has a depth of 50 μm, a width (i.e., shorter diameter) of 250 μm, and a length (i.e., longer diameter) of 2.5 mm. The ejection opening 74 of the nozzle hole 70 has a diameter of 20 μm. Employed as the ink is water-based dye ink having a viscosity of 3.0 cP and a surface tension of 39 mN/m. Under these conditions, ink was ejected from the nozzle hole 70, and a main droplet Ia and a satellite droplet Ib thus ejected were measured. Measurement results are shown in TABLE 3.

Referring to FIG. 3, both of a trajectory of the main droplet Ia and a trajectory of the satellite droplet Ib were deviated from the axis L of the nozzle hole 70. However, the trajectory of the satellite droplet Ib was more deviated from the axis L than the trajectory of the main droplet Ia was. Therefore, the projection 22 caught the main droplet Ia alone without catching the satellite droplet Ib. Thus, only the satellite droplet Ib landed on the recording sheet P.

As described above, in the ink-jet head 81 of the third embodiment, similarly in the first and second embodiments, only the satellite droplet Ib having the smaller volume lands on the recording sheet P, so that a fine dot can be formed on the recording sheet P.

In this embodiment, by means of wind pressure, the trajectory of the satellite droplet Ib can reliably be differentiated from the trajectory of the main droplet Ia. In addition, a position on the recording sheet P at which the satellite droplet Ib lands can be controlled by regulating strength of wind pressure of air which is blown out from the blower tube 83.

In the third embodiment, it is preferable to depressurize a space around the ejection opening 74 of the nozzle hole 70, which includes the trajectories of the main droplet Ia and the satellite droplet Ib. By this depressurization, it can be prevented to the full that change of a trajectory of an ink droplet ejected from the nozzle hole 70 is affected by air other than air from the blower tube 83, i.e., by air staying around the ejection opening 74 of the nozzle hole 70. For example, a pump for depressurize the space around the ejection opening 74 of the nozzle hole 70 may be provided within a housing of the ink-jet printer 100. In the above-described first and second embodiments as well, it is preferable to depressurize a space around the ejection opening 74 of the nozzle hole 70, in order to prevent a light-weighted satellite droplet Ib from slowing down due to air resistance to thereby deteriorate landing accuracy of the droplet onto the recording sheet P.

In the third embodiment, the trajectories of the main droplet Ia and the satellite droplet Ib are changed by means of the blower 82. However, this is not limitative. For example, an electric field may be applied to a region where the droplets Ia and Ib fly, so that electric attraction acts on the electrified main droplet Ia and the electrified satellite droplet Ib which have been ejected from the nozzle hole 70. Trajectories of these droplets are thereby changed. Any other methods may also be employed in order to change the trajectory of the droplet Ia and the trajectory of the droplet Ib so that the main droplet Ia can be caught in the front end of the projection while the satellite droplet Ib can land on the recording sheet P without being caught by the projection.

In the above-described first to third embodiments, the present invention is applied to a serial-type ink-jet head, as an example. However, the present invention is also applicable to a line-type ink-jet head which is elongated along a width of a recording sheet. In addition, the present invention may be applied to ink-jet heads included in ink-jet type fax machines or copying machines, not limited ink-jet heads included in printers.

Further, the present invention is applicable to apparatuses for ejecting droplets other than ink-jet heads. For example, the present invention can be applied to apparatuses for ejecting droplets used for forming a fine wiring pattern on a substrate by ejecting a conductive paste, for forming a high-resolution display by ejecting an organic luminescent material onto a substrate, for forming a micro-optical device such as an optical waveguide by ejecting optical plastics onto a substrate, and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

TABLE 1

| | MAIN DROPLET | SATELLITE DROPLET |
|---|---|---|
| DIAMETER (μm) | 23 | 7 |
| VOLUME (pl) | 6.4 | 0.18 |
| SPEED (m/s) | 8 | 5.8 |

TABLE 1-continued

| | MAIN DROPLET | SATELLITE DROPLET |
|---|---|---|
| TRAJECTORY | substantially along axis | 40 μm deviated from axis at point of 0.5 mm advanced |

TABLE 2

| | MAIN DROPLET | SATELLITE DROPLET |
|---|---|---|
| DIAMETER (μm) | 23 | 7 |
| VOLUME (pl) | 6.4 | 0.18 |
| SPEED (m/s) | 8 | 6.2 |
| TRAJECTORY | substantially along axis | substantially along axis |

TABLE 3

| | MAIN DROPLET | SATELLITE DROPLET |
|---|---|---|
| DIAMETER (μm) | 23 | 7 |
| VOLUME (pl) | 6.4 | 0.18 |
| SPEED (m/s) | 8 | 6.2 |
| TRAJECTORY | 40 μm deviated from axis at point of 0.5 mm advanced | 15 μm deviated from axis at point of 0.5 mm advanced |

What is claimed is:

1. An apparatus for ejecting droplets, comprising:

a reservoir in which liquid is reserved;

a pressure applicator that applies pressure to the liquid reserved in the reservoir;

a nozzle hole communicating with the reservoir and having an ejection opening that can sequentially eject a main droplet and a satellite droplet having a volume smaller than that of the main droplet;

a main droplet catcher positioned between the nozzle hole and an ejection object so as to come into contact with the main droplet but not with the satellite droplet, to thereby catch the main droplet alone; and a trajectory controller formed at the election opening of the nozzle hole so as to differentiate a trajectory of the satellite droplet from a trajectory of the main droplet, wherein the main droplet catcher is disposed on the trajectory of the main droplet.

2. The apparatus according to claim 1, wherein:

the trajectory controller is a protrusion formed at the ejection opening of the nozzle hole and having a distance from a center of the ejection opening except the protrusion larger than that of the ejection opening except the protrusion, a periphery of the protrusion having a curvature larger than that of a periphery of the ejection opening except the protrusion.

3. The apparatus according to claim 2, wherein the protrusion is a notch formed by notching a sidewall defining the nozzle hole along a radial direction of the ejection opening.

4. The apparatus according to claim 3, wherein the notch is formed through an entire length of the sidewall along an axis of the nozzle hole.

5. The apparatus according to claim 1, wherein:

a liquid-repellent film is formed on an ink ejection face excluding a part thereof, on which the ejection opening of the nozzle hole opens; and the trajectory controller is the part of the ink ejection face where the liquid-repellent film is not formed, the part extending from the ejection opening of the nozzle hole in a radial direction of the ejection opening.

6. The apparatus according to claim 1, wherein the main droplet catcher communicates with the reservoir.

7. An apparatus for ejecting droplets, comprising:

a reservoir in which liquid is reserved;

a pressure applicator that applies pressure to the liquid reserved in the reservoir;

a nozzle hole communicating with the reservoir and having an ejection opening that can sequentially eject a main droplet and a satellite droplet having a volume smaller than that of the main droplet; and a main droplet catcher positioned between the nozzle hole and an ejection object so as to come into contact with the main droplet but not with the satellite droplet, to thereby catch the main droplet alone, a front end of the main droplet catcher having an opening to catch the main droplet, partially overlapping the main droplet but not the satellite droplet with respect to an axis of the nozzle hole, and having a slanted shape so as to get away from the axis of the nozzle hole at a more downstream in a direction where the droplets are ejected from the ejection opening.

* * * * *